US009292028B2

(12) United States Patent
Capodivacca et al.

(10) Patent No.: US 9,292,028 B2
(45) Date of Patent: Mar. 22, 2016

(54) DIGITAL SWITCHING CONVERTER CONTROL

(71) Applicant: Infineon Technologies AG, Neubiberg (DE)

(72) Inventors: Giovanni Capodivacca, Padua (IT); Paolo Milanesi, Padua (IT); Andrea Scenini, Montegrotto Terme (IT)

(73) Assignee: Infineon Technologies AG, Neubiberg (DE)

( * ) Notice: Subject to any disclaimer, the term of this patent is extended or adjusted under 35 U.S.C. 154(b) by 542 days.

(21) Appl. No.: 13/624,696

(22) Filed: Sep. 21, 2012

(65) Prior Publication Data

US 2013/0082675 A1 Apr. 4, 2013

(30) Foreign Application Priority Data

Sep. 23, 2011 (EP) ..... 11182620

(51) Int. Cl.
*G05F 1/46* (2006.01)
*H05B 33/08* (2006.01)

(52) U.S. Cl.
CPC ..... *G05F 1/468* (2013.01); *H05B 33/0815* (2013.01); *H05B 33/0854* (2013.01)

(58) Field of Classification Search
CPC ..... H02M 3/157; H02M 2001/0012; H02M 2001/0025; H02M 2001/0009; G05F 1/468; H05B 33/0815; H05B 33/0854; H05B 41/36
USPC ..... 323/271, 282–285, 351, 222–225; 315/246, 287, 291, 294, 209 R
See application file for complete search history.

(56) References Cited

U.S. PATENT DOCUMENTS 7,330,362 B2 * 2/2008 Hesener ..... 363/65
7,408,388 B2 * 8/2008 Nagasawa et al. ..... 327/110
7,495,423 B1 * 2/2009 Knight et al. ..... 323/284

(Continued)

FOREIGN PATENT DOCUMENTS

CN 101500361 A 8/2009
JP 2006-261147 A 9/2006
JP 2007-142057 A 6/2007

OTHER PUBLICATIONS

National Semiconductor Corp., "LM3421, LM3423; LM3421 LM3421Q1 LM3421Q0 LM3423 LM3423Q1 LM3423Q0 N-Channel Controllers for Constant Current LED Drivers," Texas Instruments, Literature No. SNVS574D, Jan. 21, 2010, 50 pages.

(Continued)

*Primary Examiner* — Timothy J Dole
*Assistant Examiner* — Ivan Laboy Andino
(74) *Attorney, Agent, or Firm* — Slater & Matsil, L.L.P.

(57) ABSTRACT

A control circuit can control the operation of a switching converter to provide a regulated load current to a load. The switching converter includes an inductor and a high-side and a low side-transistor for switching the load current provided via the inductor. A digital modulator is configured to provide a modulated signal having a duty cycle determined by a digital duty cycle value. A current sense circuit is coupled to at least one of the transistors and is configured to regularly sample a load current value. A comparator is coupled to the current sense circuit and is configured to compare the sampled load current value with a first threshold and to provide a respective comparator output signal. A regulator is configured to receive the comparator output signal and to calculate an updated digital duty cycle value.

11 Claims, 4 Drawing Sheets

(56) References Cited

U.S. PATENT DOCUMENTS

| | | | | |
|---|---|---|---|---|
| 7,541,795 | B1 * | 6/2009 | Smith et al. | 323/285 |
| 7,834,828 | B2 | 11/2010 | Arakawa et al. | |
| 8,710,810 | B1 * | 4/2014 | McJimsey et al. | 323/272 |
| 2007/0019450 | A1 * | 1/2007 | Tiew et al. | 363/98 |
| 2008/0018267 | A1 * | 1/2008 | Arakawa et al. | 315/301 |
| 2008/0164859 | A1 * | 7/2008 | Peng et al. | 323/318 |
| 2009/0015172 | A1 | 1/2009 | Huang et al. | |
| 2009/0278471 | A1 | 11/2009 | Peng | |
| 2010/0079124 | A1 * | 4/2010 | Melanson | 323/283 |
| 2011/0279061 | A1 * | 11/2011 | Lee et al. | 315/307 |
| 2012/0062191 | A1 * | 3/2012 | Goto | 323/271 |

OTHER PUBLICATIONS

Lukić, Z., et al., "Multibit Σ-Δ PWM Digital Controller IC for DC-DC Converters Operating at Switching Frequencies Beyond 10 MHz," IEEE Transactions on Power Electronics, vol. 22, No. 5, Sep. 2007, pp. 1693-1707.

* cited by examiner

DIGITAL SWITCHING CONVERTER CONTROL

This application claims priority to European Patent Application No. 11182620, which was filed Sep. 23, 2011 and is incorporated herein by reference.

TECHNICAL FIELD

The present invention relates to the digital control of a switching converter, particularly to closed loop control of DC/DC converters for providing a specific desired current to illumination devices which are, e.g., based on light emitting diodes (LEDs).

BACKGROUND

Switching converters such as DC/DC converters usually provide a regulated output voltage. However, in some applications a regulated output current is required. This is particularly the case when the load to be supplied with electrical energy is current driven. One important type of current-driven loads are light emitting diodes (LEDs) which become increasingly important in the field of illumination devices.

Modern LED-based illumination devices usually include a series circuit of several individual LEDs. Thus, the LEDs "share" a common regulated load current whereas the corresponding voltage drops across the LEDs may vary as a result of temperature variations and aging. Further, the forward voltages of the individual LEDs may significantly differ due to unavoidable tolerances caused by the production process.

For a number of reasons (the most important is efficiency) switching converters providing a regulated output current (load current) are preferred over linear regulators. Load current control, however, requires a load current feedback and thus a load current sense circuit. For this purpose a precise low ohmic sense resistor is usually used. As such a resistor cannot be integrated in an integrated circuit (IC) it has to be provided as an external (i.e., not integrated in an IC) device. Further, a filter circuit may be required to filter the current sense signal (i.e., the voltage drop across the sense resistor) as it is the mean load current which is relevant for the visible brightness of the LEDs. One example for a fully integrated LED driver circuit including control circuitry for operating an appropriate switching converter is the device LM3421 from National Semiconductors (see datasheet LM3421, LM3421Q1, LM3421Q0, LM3423, LM3423Q1, LM3423Q0, "N-Channel Controllers for Constant Current LED Drivers," National Semiconductor, January 2010).

In view of the existing switching converter control circuits that provide a regulated output current there remains a need for improvement, particularly for integrated control circuits that require fewer external components which cannot be readily integrated in one or more semiconductor chips provided in a one single chip package.

SUMMARY OF THE INVENTION

A control circuit is configured to control the operation of a switching converter to provide a regulated load current to a load. The switching converter includes an inductor and a high-side and a low side-transistor for switching the load current provided via the inductor. The circuit includes a digital modulator configured to provide a modulated signal having a duty cycle determined by a digital duty cycle value. A current sense circuit is coupled to at least one of the transistors and is configured to regularly sample a load current value. A comparator is coupled to the current sense circuit and is configured to compare the sampled load current value with a first threshold and provide a respective comparator output signal The first threshold is dependent on a defined desired output current and the comparator output signal is indicative of whether the sampled current value is lower or greater than the desired output current. A regulator is configured to receive the comparator output signal and to calculate an updated digital duty cycle value.

BRIEF DESCRIPTION OF THE DRAWINGS

The invention can be better understood with reference to the following drawings and description. The components in the figures are not necessarily to scale, instead emphasis being placed upon illustrating the principles of the invention. Moreover, in the figures, like reference numerals designate corresponding parts. In the drawings.

DETAILED DESCRIPTION OF ILLUSTRATIVE EMBODIMENTS

In the following the present invention is discussed using a LED driver as an example. It should be noted, however, that the switching converter control circuit can readily be employed to provide any arbitrary load (other than LEDs) with a regulated load current. In the examples discussed herein a buck converter is used. However, any other switching converter, such as a boost converters, a buck-boost converter, a boost-buck (split-pi) converter, a Ĉuk converter, a SEPIC converter, a zeta converter, etc. may be employed instead.

Figure 1:
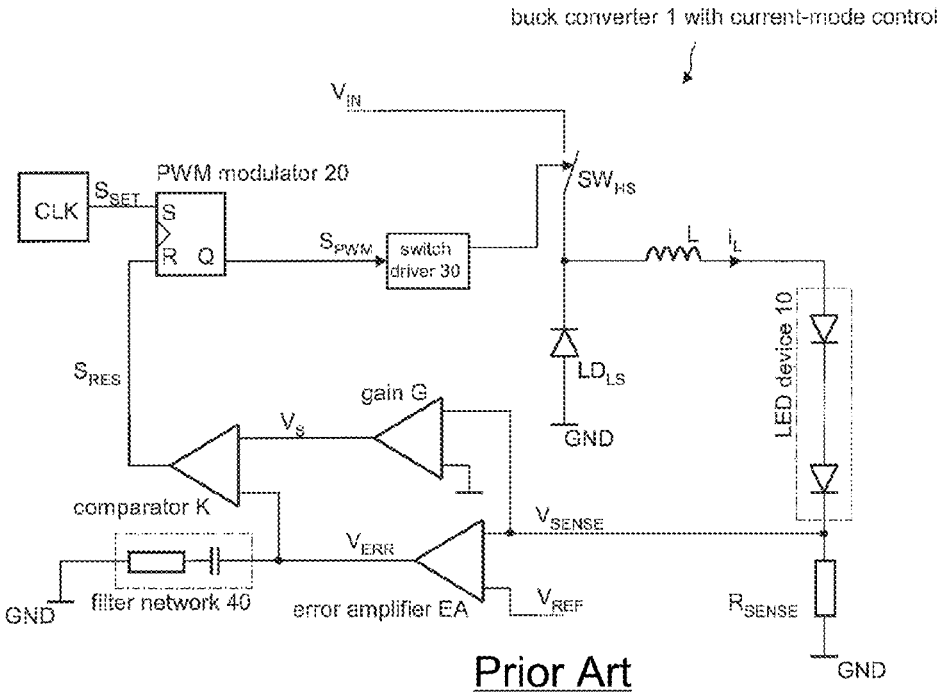
FIG. 1 illustrates a conventional circuit for driving a series circuit of LEDs, the circuit includes a buck converter and appropriate control circuitry.

FIG. 1 illustrates the function and the basic structure of a buck converter and a respective control circuit for controlling the switching operation thereof thereby implementing an output current regulation. In the present example, the switching converter is a buck converter including the high side switch $SW_{HS}$ (e.g., a MOSFET) and a low side switch, which is a diode $SW_{LS}$ in the present example. Both switches are connected in series to form a half bridge which is coupled between an upper supply potential $V_{IN}$ and a lower supply potential, e.g., ground potential GND. The common circuit nodes between the two switches $SW_{HS}$, $SW_{LS}$, i.e., the output node of the half bridge, is connected to a first terminal of an inductor L. A second terminal of the inductor L can be seen as buck converter output node which is connected to a load, e.g., to the LED device 10, to supply it with a load current $i_L$. The LED device includes a plurality of LEDs connected in series.

In order to provide a load current feedback a sense resistor $R_{SENSE}$ is connected in series with the LED device 10. The voltage drop $V_{SENSE}=i_L \cdot R_{SENSE}$ across the sense resistor is representative of the actual load current $i_L$ supplied to the load 10.

The switching converter control circuit includes a modulator 20, which may be implemented as a simple SR-latch to realize a pulse width modulation (PWM). The modulator 20 is clocked by clock generator CLK. In the present example, the clock signal $S_{SET}$ provided by the clock generator CLK is supplied to the set input S of the SR-latch to set the output Q of the latch to a high level (i.e., logic "1") at the beginning of each clock cycle $T_{PWM}$. Thus, the switching frequency of the switching converter $f_{PWM}=T_{PWM}^{-1}$ is determined by the clock generator CLK and usually constant. The reset input R of the SR latch 20 is supplied with a reset signal $S_{RES}$. Thus, the time instant at which the reset signal $S_{RES}$ resets to output of the SR-latch 20 to a low level (logic "0") determines the duty cycle DS of the output signal $S_{PWM}$ of the SR-latch which is further referred to as PWM signal. The on-time of the PWM signal $S_{PWM}$ is $D \cdot T_{PWM}$ whereas the off-time is $(1-D) \cdot T_{PWM}$, i.e., when D=0.3 then the modulator output signal $S_{PWM}$ is at a high level for 30 percent of one switching cycle and at a low level for the remaining 70 percent. The PWM signal $S_{PWM}$ determines the actual switching state of the switches $SW_{HS}$ and $SW_{LS}$. The high side switch $SW_{HS}$ is actively switched on while the PWM signal $S_{PWM}$ is at a high level, whereas it is switched off while the PWM signal $S_{PWM}$ is at a low level and the low side switch (the diode $SW_{LS}$ in the present example) is conductive.

The time instant at which the reset signal $S_{RES}$ resets the SR-latch 20, and thus the duty cycle of the PWM signal, is controlled dependent to the sensed current signal $V_{SENSE}$ in such a manner that the mean load current $\text{avg}\{i_L\}$ matches a desired load current defined by the reference signal $V_{REF}$. In the present example the desired load current can be calculated as $V_{REF}/R_{SENSE}$.

The current sense signal $V_{SENSE}$ is subtracted from the reference signal $V_{REF}$ and the difference $V_{REF}-V_{SENSE}$ is amplified by the amplifier EA generally referred to as error amplifier. A filter network 40 is coupled to the amplifier output. However, in some applications the filter network 40 may be coupled to the error amplifier input. The filter network 40 is often referred to as "loop compensator" and is required for ensuring the stability of the closed loop control system.

The error signal $V_{ERR}$ provided by the error amplifier EA and the filter network 40 as well as current sense signal $V_{SENSE}$ (which may be optionally amplified by a gain G) are compared using a comparator K. When the (amplified) current sense signal $V_{SENSE}$ reaches the error signal $V_{ERR}$, then the comparator K triggers the reset of the SR-latch 20 thereby closing the current feedback loop. The switching converter control circuit of FIG. 1 may be integrated into one single chip to a large extent. However, besides the inductor L the current sense resistor $R_{SENSE}$ and the filter network 40 (the loop compensator) have to be provided as external components.

Figure 2:
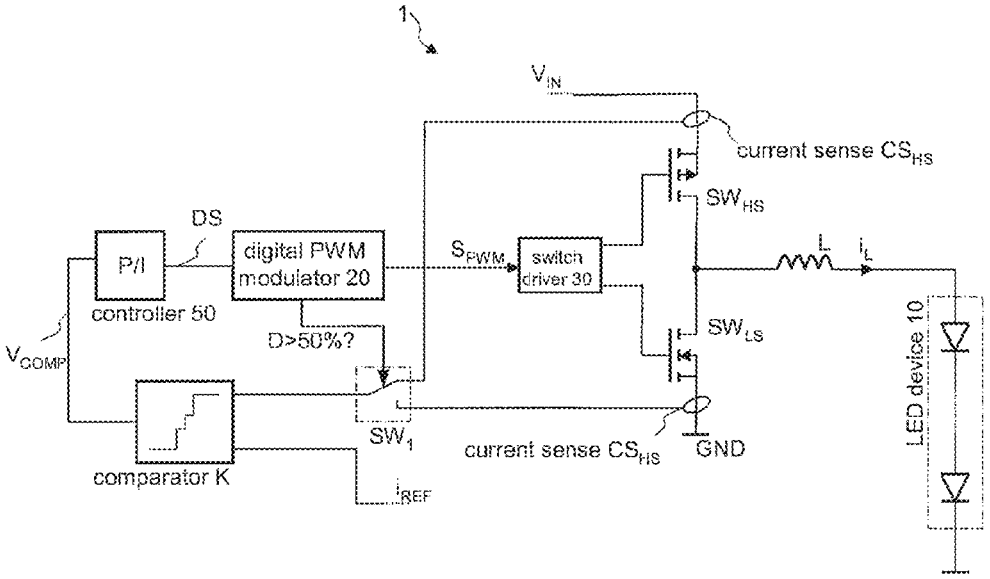
FIG. 2 illustrates, as one exemplary embodiment of the present invention, a LED driver circuit including an improved digital control circuit for operating the switching converter which supplies current to the LEDs.

The control strategy implemented by the circuit of FIG. 1 is usually referred to as current-mode control which is usually implemented in the analog domain and not readily transformed into a digital implementation. To reduce the external components and to overcome restrictions resulting from the temperature dependence and from aging of the external components, a digital implementation is proposed. Dependent on the actual (digital) implementation limit-cycle oscillations may occur at the switching converter's output. When implementing the function provided by the error amplifier EA, the comparator K and the SR-latch 20 digitally (e.g., using a micro controller executing appropriate software) these limit cycle oscillations become manifest in current steps present in the regulated output current $i_L$. As the oscillations usually do not have a defined frequency, they cannot be compensated for and are thus visible in the load current. One option to reduce the oscillations would be to increase the resolution of the (digital) PWM modulator 20. However, this would significantly increase the complexity of the overall system. An example of an alternative digital control circuit, which does not require a high-resolution PWM modulator 20, is illustrated in FIG. 2. Further, the example of FIG. 2 does not necessarily require an external loop compensator or an external sense resistor.

The switching converter included in the circuit of FIG. 2 is also a buck converter. A MOS transistor half-bridge may be used to switch the inductor current. However, other types of switches may be applicable, too. As in the previous example the inductor L is coupled between the common node (half bridge output node) of the two switches $SW_{HS}$, $SW_{LS}$ and the switching converter output node connected to the load (e.g., LED device 10). A MOS switch driver 30 is used to sequentially activate and deactivate the MOS transistors $SW_{HS}$, $SW_{LS}$ in accordance with a PWM signal $S_{PWM}$ similar to the circuit of FIG. 1. In contrast to the example of FIG. 1 the load current is not sensed at the load 10 with a sense resistor coupled in series with the load. The load current is rather sensed at the high side transistor $SW_{HS}$ and the low side transistor $SW_{LS}$ of the half-bridge. For current sensing at the transistor's sources a so-called "sense transistor" arrangement may be readily used, wherein one or a view of a plurality transistor cells, which form the load transistor, are used to sense the a current representative of the load current $i_L$ at a separated source or drain terminal. As such sense transistor (or sense FET) arrangements are sufficiently known, the details are not presented here and the current sense arrangement is only schematically depicted as high side current sense $CS_{HS}$ and low side current sense $CS_{LS}$ in FIG. 2. Both current sensing arrangements $CS_{HS}$, $CS_{LS}$ provide a signal representative of the respective transistor current (which also flows through the inductor).

For the further discussion one should keep in mind that the depicted components (comparator K, controller 50, modulator 20) are at least partially implemented digitally, e.g., in a micro controller using appropriate software. However, the comparator may be, for example, a designated component configured to compare the current sense representative provided by the current sense arrangement $CS_{HS}$ or $CS_{LS}$ with a reference current $i_{REF}$. The comparator output $V_{COMP}$ may provide a first value B when the sampled load current $i_L$ is below the reference current $i_{REF}$, and the comparator output $i_{COMP}$ may provide a second value C when the sampled load current $i_L$ is above the reference current $i_{REF}$.

The comparator output $i_{COMP}$ is calculated or sampled once each PWM cycle (period $T_{PWM}$). Therefore, a digital load current value $i_L$ may sampled in the middle of a duty cycle (on time interval) or in the middle of the off time interval (see also FIG. 3), dependent on the actual value of the duty cycle D. For duty-cycles DS greater than approximately 50 percent the load current is sampled at the high-side switch $CS_{HS}$, for duty-cycles DS lower than approximately 50 percent the load current is sampled at the low-side switch $CS_{LS}$. The switch-over from current sampling at the high-side to the low-side may have a hysteresis. For example, the load current is sampled at the high-side transistor for duty-cycles DS greater than 55 percent (a threshold of 50 percent plus an offset). When the duty-cycle drops below 45 percent (the threshold of 50 percent minus the offset) current sampling is switched over to the low-side transistor. For duty-cycles DS lower than said 45 percent the load current is sampled at the low-side transistor. Finally, when the duty-cycle rises above said 55 percent, current sampling is switched back to the high-side transistor, and so on. The offset is considered to be small compared to 50 percent, e.g., 15 percent, 10 percent or 5 percent or even less. The hysteretic behavior is included when saying the current is sampled at the high- or low-side for duty cycles of "approximately" more than 50 percent or, respectively, of "approximately" less than 50 percent. The change of the current sense transistor (from the high-side to the low-side transistor and vice versa) dependent on the duty-cycle improves the quality of current measurement. Assuming a PWM switching frequency $f_{PWM}$ of 1 MHz (i.e., $T_{PWM}$=1 μs) and a duty cycle of 5 percent then the on-time ($t_3-t_1$ and $t_7-t_5$ in FIG. 3) would be only 50 ns. If the current would be sampled at the high side-transistor in the middle of the on-time (e.g., at $t_2$ or $t_6$ in FIG. 3) then the current sample would have to be taken only 25 ns after the rising edge which may be problematic due to switching transients, noise and the required settling time. In contrast, when the current sample is taken during the off-time at the low-side transistor (as it actually is), then the current sample is taken 475 ns after the switching edge after the switching transients have settled.

It is appreciated that the comparator may be regarded as 1-bit analog-to-digital converter. However, it may be useful to add further comparator thresholds so as to form a nonlinear 2-bit analog-to-digital converter as will be explained further below. The comparator output signal $V_{COMP}$ is supplied to a digital controller 50, e.g., a P/I-controller having a proportional and a integrating component. The controller 50 is configured to tune the duty cycle DS provided by the modulator 20 such that the average load current matches the reference current (i.e., the mean error current $i_{SENSE}-i_L$ is zero). The digital PWM modulator 20 is essentially configured to convert a digital value representing the duty cycle into a modulated output signal $S_{PWM}$ having said duty cycle. As in the example of FIG. 1 the PWM signal $S_{PWM}$ is supplied to a switch driver 30 which drives the switches $SW_{HS}$, $SW_{LS}$ on and off in accordance with the PWM signal $S_{PWM}$.

Figure 3:
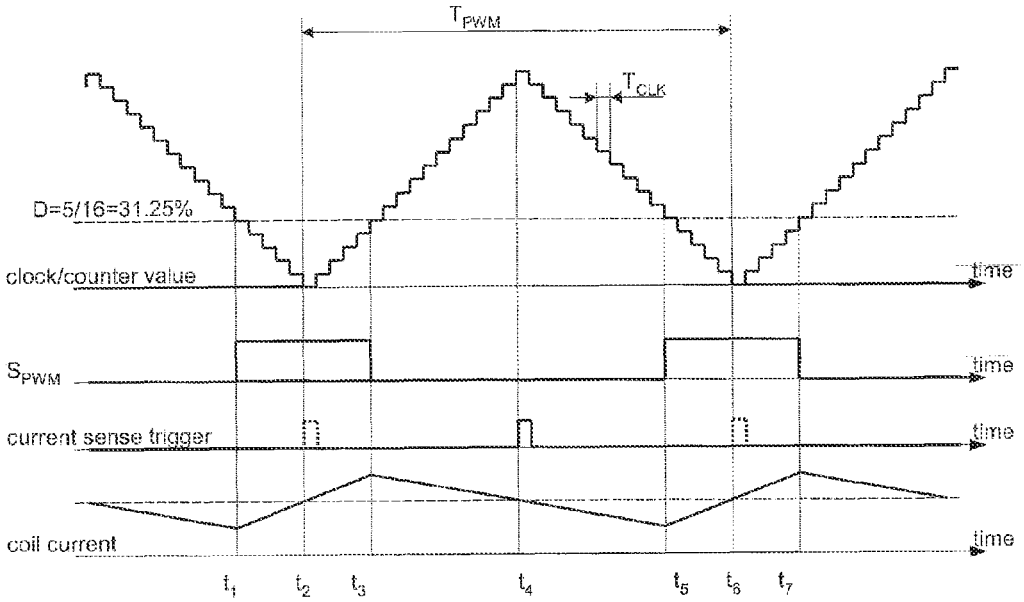
FIG. 3 is a timing diagram showing some signals in the circuit of FIG. 2 in order to illustrate the function of the circuit.

The function of the circuit illustrated in FIG. 2 is now explained in more detail with reference to the timing diagram depicted in FIG. 3. The digital part of the control circuit is clocked by a clock generator whose frequency $f_{CLK}=T_{CLK}^{-1}$ determines the resolution of the digital PWM modulator 20. If the resolution of the digital PWM modulator is n bits (e.g., PWM signals $S_{PWM}$ may be generated with $2^n$ different duty cycles), the frequency $f_{CLK}$ has to be a factor of 2" higher than the desired PWM frequency $f_{PWM}=T_{PWM}^{-1}$, i.e., $T_{CLK}\cdot 2^n=T_{PWM}$. In the example of FIG. 3 the resolution of the PWM modulation is 4 bit (n=4). The digital modulator 20 is usually implemented using a digital counter counting up and down from zero to $2^n-1$ (0 to 15 in the present example) and vice versa. The PWM signal $S_{PWM}$ (modulator output signal) is set to a high level (i.e., to logic value "1") when the counter value drops to a threshold value defining the duty cycle. The PWM signal $S_{PWM}$ is reset to a low level (i.e., to logic value "0") when the counter again reaches the threshold. In the present example the threshold is 5, which corresponds to a duty cycle of 5/16 or 31.25 percent. The minimum duty cycle would be 6.25 percent. As the counter counts up and down the position of the on-pulse changes from the beginning of a PWM cycle to the end of a PWM cycle. As a result the effective PWM period doubles to $T_{CLK}\cdot 2^{n+1}$. However, alternative solutions may use counters which count only in one direction and overflow when reaching the maximum or minimum value. The two upper timing diagrams of FIG. 3 illustrate the function of the digital PWM modulator 20 as discussed above. Alternatively, other types of digital PWM modulators may be used, such as described, for example, in the publication Zdravko Lukić et al.: "Multibit Σ-Δ PWM Digital Controller IC for DC-DC Converters Operating at Switching Frequencies Beyond 10 MHz," in: IEEE Trans. on Power Electronics, vol. 22, no. 5, September 2007, where a Σ-Δ modulator is used to reduce the word length of the digital (e.g., 16 bit) controller output word.

As can be seen from the third timing diagram the load current is sampled either when the counter is at its maximum or at its minimum which is in the middle of the on-time or on the off-time, respectively, as discussed in details above. The bottom diagram of FIG. 3 illustrates the corresponding load current $i_L$ which rises (approximately linearly) during the on-time of the PWM signal $S_{PWM}$ and falls (also approximately linearly) during the off-time of the PWM signal $S_{PWM}$.

Figure 4:
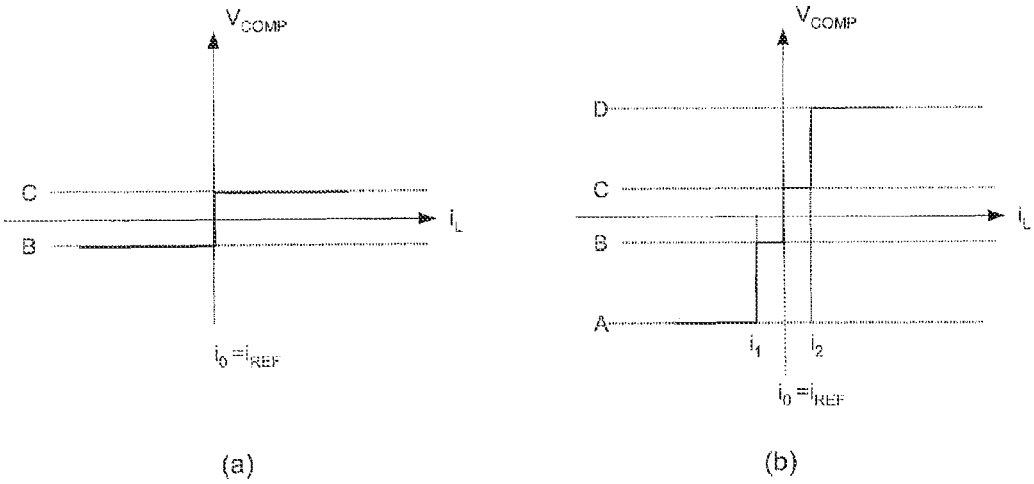
FIG. 4 is a diagram showing the characteristic curve of a comparator used in the circuit of FIG. 2.

FIG. 4 illustrates two exemplary characteristic curves of the comparator K illustrated in FIG. 2. FIG. 4*a* illustrates the case mentioned above, in which the comparator has only a single threshold $i_0$. This threshold may be equal to the desired load current $i_{REF}$ when the sampled load current value is directly supplied to the comparator thereby avoiding the need for a separate error amplifier EA. That is, in the example of FIG. 4 the comparator output signal $V_{COMP}$ may assume only two values B and C, wherein $V_{COMP}$=B when $i_L<i_{REF}$ and $V_{COMP}$=C when $i_L>i_{REF}$. In a digital implementation the values B and C may be chosen to be −1 and 1, respectively.

An alternative comparator characteristic is illustrated in FIG. 4*b*. In order to improve the dynamic behavior of the feedback loop two additional comparator thresholds $i_1$ and $i_2$ are introduced. They are fixed and symmetrically about $i_0=i_{REF}$, i.e., $i_1=i_{REF}-\Delta i$ and $i_1=i_{REF}+\Delta i$, wherein Δi may be, for example 62.5 mA and thus negligible as compared to typical reference currents. As a rule of thumb the value Δi may be set to about ten percent of the value of the reverence current $i_{REF}$, so that the system becomes "faster" until the load current $i_L$ deviates from the reference current by less than ten percent. However, in an real implementation the actual value Δi should be verified by simulation to check for possible instabilities due to intrinsic non-linearities. In the depicted example the comparator output signal $V_{COMP}$ may assume only four values A, B, C and D, wherein $V_{COMP}$=A when $i_L<i_1$, $V_{COMP}$=D when $i_L>i_2$, $V_{COMP}$=B when $i_1<i_L<i_0$, and $V_{COMP}$=C when $i_0<i_L<i_2$. Generally the following relation holds: A<B<C<D, wherein in a digital implementation the values B and C may be chosen as −1 and 1, respectively, and the values A and D may be chosen as −8 and 8, respectively. However, other values greater than 1 (and lower than −1) are applicable. As can be seen from FIG. 4*b* the comparator may be regarded as analog-to-digital converter having a non-linear characteristics.

Figure 5:
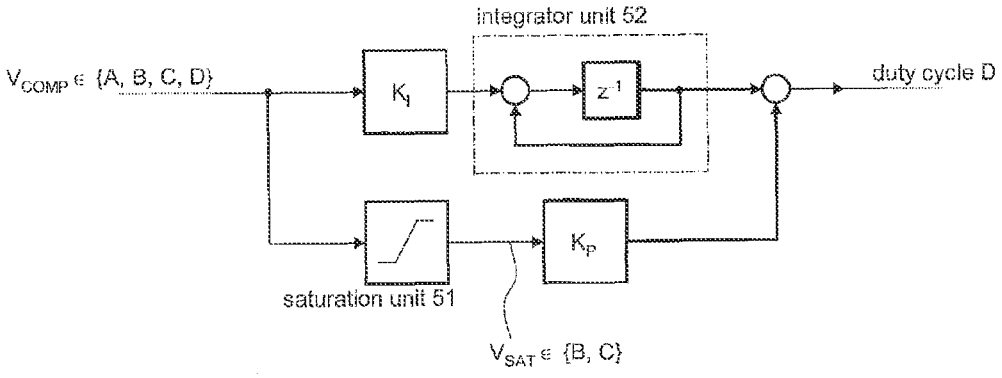
FIG. 5 illustrates one example of the controller used in the circuit of FIG. 2 in more detail.

As illustrated in FIG. 4, the comparator output $V_{COMP}$—which can be regarded as (e.g., non-linearly) discretized error signal—is supplied to the P/I-regulator 50 which is discussed below in more detail with reference to FIG. 5. The regulator is implemented digitally and includes a proportional and a integrating path, both paths receiving as input the comparator output signal $V_{COMP}$. The output of both paths is summed to form the regulator output which is an updated duty cycle value DS supplied to the digital PWM modulator 20. The integrating path includes a digital integrator unit 52 and a corresponding gain $K_I$. The proportional path includes a gain $K_P$ and a saturation unit 51 to avoid instability due to the nonlinear behavior of the comparator K. The saturation unit 51 limits the input to the proportional path to the comparator output values B and C (−1, 1 in the example mentioned above)

having the lowest magnitude. That is when the comparator output rises to D (or falls to A) the value "seen" by the proportional path is still C (or B, respectively). In the example, where the values B and C are −1 and 1, respectively, the saturation unit may simply implement the sign function. It should be noted that an updated duty cycle value DS is calculated only once in each PWM cycle $T_{PWM}$.

The gain values $K_I$ and $K_P$ are chosen to ensure stability of the closed loop system. Particularly, the proportional gain may be set to $K_P=1/(2^n)$, wherein n is the number of bits determining the resolution of the modulator 20. In a steady state such a setting produces an oscillation of the least significant bit (LSB) of the duty cycle D. The band-width BW of the closed loop system is determined by the gain $K_I$ which may be approximately set to $K_I=K_P \cdot BW \cdot T_{PWM}$.

The above mentioned oscillation has a frequency of $f_{PWM}/2$ and is thus high enough to be not perceivable as a visible intensity modulation of the LEDs supplied with the output load. The design of the switching converter control circuit allows further to relax the requirements for the modulator resolution as compared to known circuits where the duty cycle is not changed in steady state. In the latter case limit cycles would occur at low frequencies which may produce a visible flickering of the supplied LEDs when the resolution of the modulator is not high enough (particularly when not using the mentioned Σ-Δ PWM).

Figure 6:
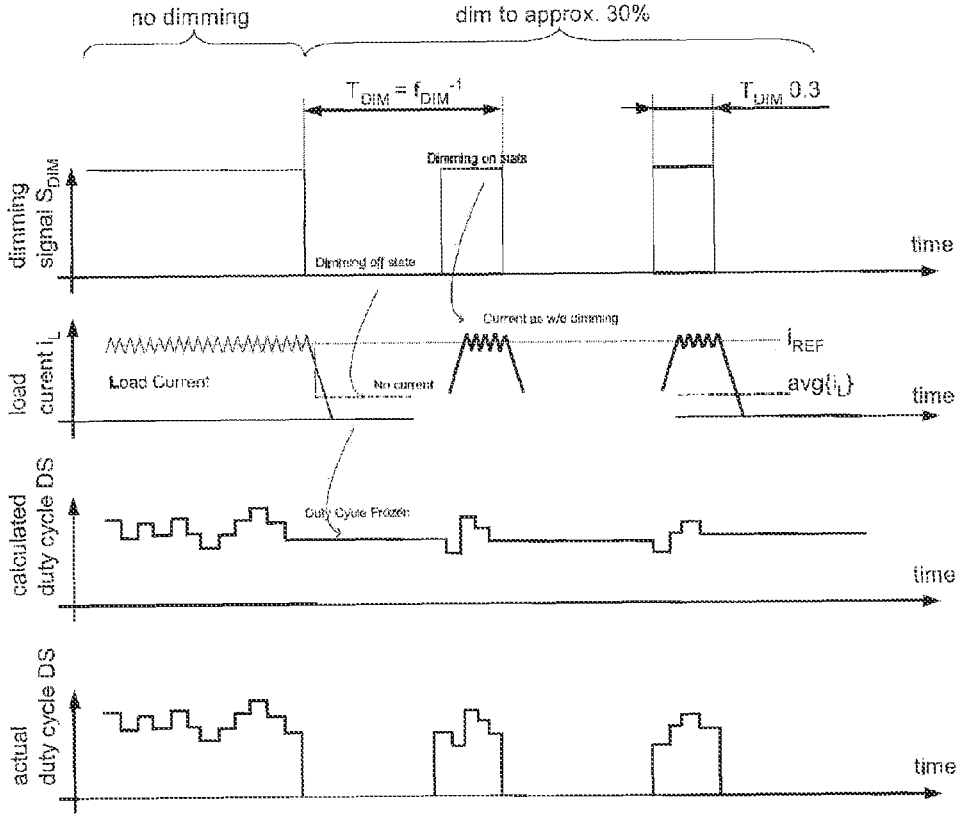
FIG. 6 illustrates in exemplary timing diagrams the principle of the dimming capability of the circuit of FIG. 2.

The band-width of the closed loop system has some impact on the dimming capabilities of the circuit when the circuit is used to drive a LED device. FIG. 6 illustrates how dimming is implemented in the present system. As the luminous intensity of the LED device 10 is proportional to the average load current (at least when variations of the load current are fast enough that they cannot be perceived by the human eye and thus flickering is avoided), the LED device 10 may be dimmed to, e.g., 30 percent of the maximum intensity by regularly interrupting the load current flow for said 30 percent of the time. This regular interruption of the current flow may also follow the principle of a pulse width modulation, whereby the frequency $f_{DIM}$ of the PWM modulation applied for dimming should be greater than 200 Hz, e.g., 1 kHz. In contrast thereto the frequency $f_{PWM}$ of the PWM signal $S_{PWM}$ used in the closed loop control system is much higher, e.g., 500 kHz or 1 MHz. The low frequency PWM signal used for dimming is further denoted as "dimming signal" $S_{DIM}$. When the signal $S_{DIM}$ has a high level (i.e., "1") the switching converter (e.g., as shown in FIG. 2) operates as discussed above with reference to FIGS. 2 to 5. When the dimming signal $S_{DIM}$ is at a low level (e.g., "0"), the output of the digital PWM modulator 20 (see FIG. 2) is set to zero thus stopping the provision of load current to the load. At the same time the digital control loop is "frozen" (paused), i.e., the operation of the P/I-regulator 50 is stopped, e.g., by storing and not updating its output value (the duty cycle D). When the dimming signal $S_{DIM}$ is set back to a high level, the normal operation of the switching converter is resumed with the duty cycle value DS that has been calculated before interrupting the switching converter operation. This behavior is illustrated in FIG. 6.

The upper timing diagram of FIG. 6 illustrates the dimming signal $S_{DIM}$ when switching from no dimming (dimming ratio 1) to a dimming ratio of 0.3 (i.e., 30 percent of the reference current resulting in 30 percent of the maximum luminous intensity). The second timing diagram of FIG. 6 illustrates the resulting load current $i_L$ supplied to, for example, the LED device 10. The third diagram illustrates the calculated duty cycle D. It can be seen that the updating of the duty cycle values DS is inhibited during the off-state of the dimming signal $S_{DIM}$. The actually applied duty cycle, however, is zero during that off-state of the dimming signal $S_{DIM}$ (see bottom diagram of FIG. 6). The above-mentioned oscillation of the least significant bit of the duty cycle can also be seen in the last two diagrams of FIG. 6.

Figure 7:
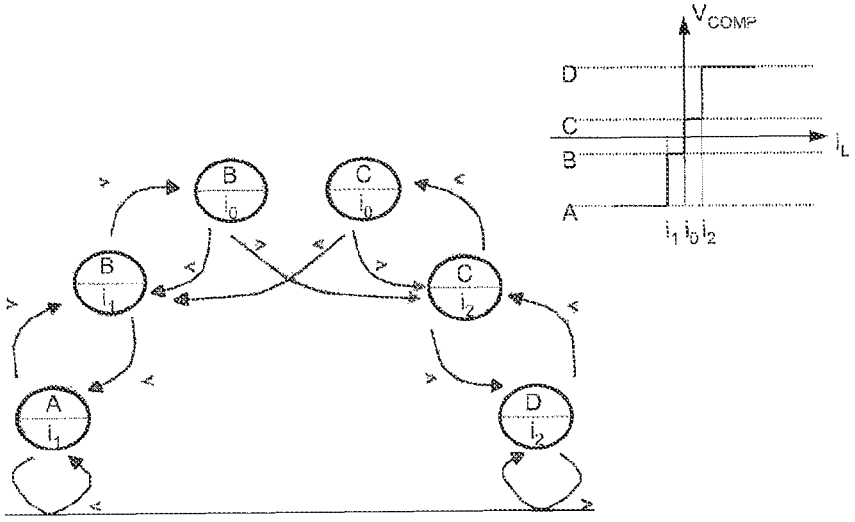
FIG. 7 illustrates one exemplary implementation of the comparator as shown in FIG. 4*b* as a state machine.

A very efficient implementation of the control circuit of FIG. 2 is now explained with reference to FIGS. 7 and 8. As mentioned above, the function of the error amplifier may be taken over by the comparator by shifting the comparator threshold by the value of the reference current $i_{REF}$. FIG. 7 illustrates the implementation of the comparator of FIG. 4*b* using a state machine which may be implemented in a micro controller executing appropriate software. Each states is sketched as a circle, wherein the value (A, B, C, D) printed in the upper half of the circle is the resulting comparator output supplied to the controller 50 during the respective state and the current printed in the lower half of the circle is the corresponding comparator threshold. The arrows indicate changes from one state to another, wherein arrows labeled with a ">" symbol denote the state changes performed as a response to a load current higher than the respective threshold, and arrows labeled with a "<" symbol denote the state changes performed as a response to a load current lower than the respective threshold.

The diagram of FIG. 7 is further explained by means of an example and assuming a load current smaller than the threshold $i_1$ ($=i_{REF}-\Delta i$) and thus the comparator output $V_{COMP}$ equals A (leftmost state in FIG. 7). Now, it is assumed that the current rises to a value between $i_1$ and $i_0$ ($=i_{REF}$), starting from the first state on the left. As the load current is above $i_1$ the second state is B and the threshold is kept at $i_1$ (cf. second state from the left). At the next step as the current is again above $i_1$ the output is B and the new threshold is $i_0$ (cf. third state from the left). Next, as the load current is below $i_0$, the output is B and the threshold is set back to $i_1$ and so on. As long as the load current is between $i_1$ and $i_0$, the state machine alternates between the two state providing an output value B so as to alternatingly check both thresholds $i_1$ and $i_0$. If the load current $i_L$ rises above the threshold $i_0$, the state machine jumps to two state to the right (fifth state from the left, second state from the right) thereby changing the output value from B to C and the threshold to $i_2$. As long as the load current is between $i_0$ and $i_2$, the state machine alternates between the two state providing an output value C so as to alternatingly check both thresholds $i_0$ and $i_1$. Finally, when the load current rises above the threshold $i_2$, the state machine jumps to the state providing the output value A thereby keeping the threshold at $i_2$.

Figure 8:
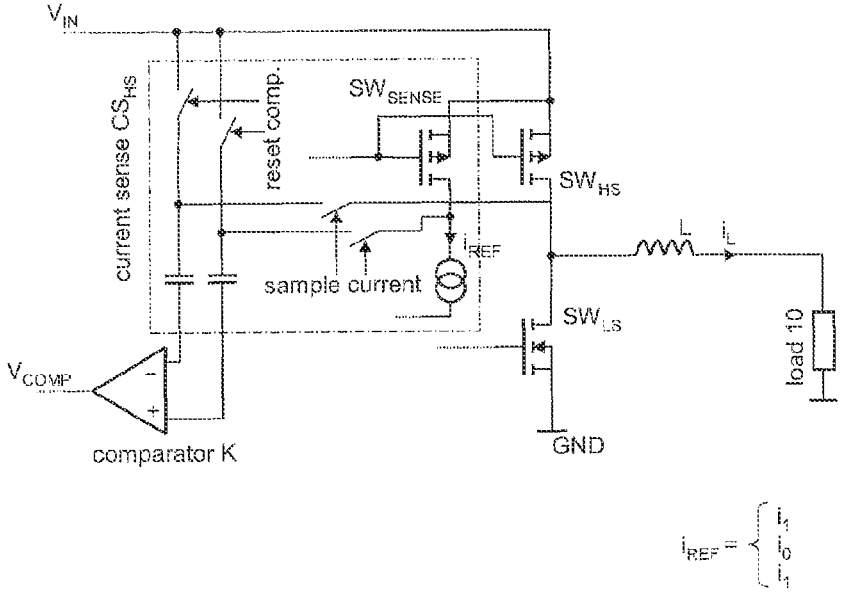
FIG. 8 illustrates one example of the current sense circuit as illustrated in the example of FIG. 2.

The comparator implementation as state machine may be particularly opportune in connection with the current sense circuit of FIG. 8. Thereby the comparison is not implemented as software but using a specific comparator K. The thresholds $i_{TH} \in \{i_1, i_0, i_2\}$ are, however set by the micro controller software using a current output digital-to-analog-converter or the like.

The circuit of FIG. 8 includes the load 10 (e.g., the LED device), the switching converter comprising the transistor half bridge with the two load transistors $S_{WHS}$ and $SW_{LS}$ and the inductor L as well as the high side current sense circuit $CS_{HS}$ and the comparator K. The high side transistor $SW_{HS}$ has a sense transistor $SW_{SENSE}$ coupled in parallel. In the present example the gates and the source electrodes of the transistors are $SW_{HS}$ and $SW_{SENSE}$ are connected whereas the drain electrode of the sense transistor $SW_{SENSE}$ is connected with a current source providing a current $i_{TH}$ which determines the comparator threshold, i.e., the value of the threshold current $i_{TH}$ changes in accordance with the states illustrated in FIG. 7. To be precise the threshold current is equals the thresholds of FIG. 7 scaled by the ratio or the active areas of both transistors.

If both transistors are $SW_{HS}$ and $SW_{SENSE}$ operate in the same operating point their drain and source potentials are equal. If the threshold current $i_{TH}$ is higher or lower than the corresponding load current then the drain potentials of the two transistors differ from each other which may be detected by the comparator K. The inputs of the comparator K are capacitively coupled (coupling capacitors $C_1$, $C_2$) to the corresponding drain terminals of the two transistors wherein the connections may be interrupted by two switches, which are closed at the sampling time instant (cf. FIG. 3, third timing diagram illustrating the "current sense trigger" which indicates the time instant when the respective drain potentials are sampled). Before sampling the drain potentials, however, the comparator is initialized by applying a defined voltage across both coupling capacitors $C_1$ and $C_2$. In the present example, one terminal of the coupling capacitors $C_1$, $C_2$ is connected with the input voltage and the other terminal of the coupling capacitors $C_1$, $C_2$ is connected with the comparator output. This initialization is triggered by an appropriate trigger signal before sampling the drain potentials of the load and the sense transistor $SW_{HS}$, $SW_{SENSE}$. As the resulting comparator output has only two different states the result of the comparison may be readily processed by the micro controller executing appropriate software.

What is claimed is:

1. A control circuit for controlling the operation of a switching converter to provide a regulated load current to a load, the switching converter comprising an inductor, a high-side transistor and a low-side transistor for switching the load current flowing through the inductor, the control circuit comprising:

a digital modulator configured to provide a modulated signal having a duty cycle determined by a digital duty cycle value;

a current sense circuit configured to be coupled to at least one of the high-side transistor and the low-side transistor and configured to regularly sample a load current value;

a comparator coupled to the current sense circuit and configured to:

compare the sampled load current value with a first threshold, a second threshold and a third threshold, and provide a respective comparator output signal, wherein the first threshold is dependent on a defined desired output current, the comparator output signal indicates whether the sampled current value is less than or greater than the defined desired output current the comparator output signal further indicates whether the sampled load current differs from the defined desired output current by more than an amount determined by the second and third threshold, respectively, the comparator output signal is set to a first value when the sampled load current is below the second threshold, to a second value when the sampled load current is between the second threshold and the first threshold, to a third value when the sampled load current is between the first threshold and the third threshold, and to a fourth value when the sampled load current is higher than the third threshold, wherein the first, second, third and fourth values nonlinearly depend on the sampled load current value; and a regulator configured to receive the comparator output signal and to calculate an updated digital duty cycle value.

2. The control circuit of claim 1, wherein:

the high-side transistor comprises a first load path terminal coupled to a first power supply node and a second load path terminal coupled to the inductor;

the low-side transistor comprises a first load path terminal coupled to a second power supply node and a second load path terminal coupled to the inductor;

the current sense circuit comprises a sense transistor having a control node configured to be coupled to a control node of the at least one of the high-side transistor and the low-side transistor, a first load path terminal coupled to at least one of the first power supply node and the second power supply node, and a second load path terminal coupled to a current source; and the comparator comprises a first input terminal coupled to the second load path terminal of the at least one high-side transistor and the low-side transistor and a second input terminal coupled to the second load path terminal of the sense transistor.

3. The control circuit of claim 1, wherein the regulator has a integrating path and a proportional path, both paths including a gain and the proportional path including a saturation element.

4. The control circuit of claim 1, wherein the comparator output signal represents a nonlinear quantization of the load current, the nonlinear quantization being coarse such that the regulated load current performs a limit cycle across the defined desired output current with a frequency corresponding to a modulation frequency of the digital modulator.

5. The control circuit of claim 1, wherein the digital modulator is configured to set the modulated signal to such a value that a flow of the load current is stopped in response to a dim control signal, and wherein the regulator is configured to maintain the digital duty cycle value while the dim control signal stops the flow of the load current.

6. The control circuit of claim 5, wherein the dim control signal is a modulated signal with a modulation period being longer by a factor of at least 10 than a modulation period of the digital modulator.

7. The control circuit of claim 2, wherein a current of the current source corresponds to the first threshold.

8. A method for controlling the operation of a switching converter to provide a regulated load current to a load, the switching converter comprising an inductor and a high-side transistor and a low-side transistor for switching the load current flowing through the inductor; the method comprising:

providing a modulated signal that has a duty cycle determined by a digital duty cycle value;

regularly sampling a load current value;

comparing the sampled load current value with a first threshold to provide a respective comparison output signal, wherein the first threshold is dependent on a defined desired output current and the comparison output signal is indicative of whether the sampled current value is lower or higher than the defined desired output current, wherein comparing comprises providing the comparison output signal and a predefined output value that depends on a state of a state machine, and comparing the sampled load current value with a variable threshold that depends on the state of the state machine, wherein each state of the state machine is associated with a defined output value and a defined threshold, wherein a number of defined output values equals a number of defined thresholds plus one; and calculating an updated digital duty cycle value from the comparison output current signal in accordance with a given control law.

9. The method of claim 8, wherein sampling a load current value comprises sampling a source or drain potential of the high-side transistor or the low-side transistor.

10. The method of claim 9, wherein comparing the sampled load current value with a first threshold comprises comparing the source or drain potential of the high-side or low-side transistor with a respective source or drain potential of a corresponding sense transistor, wherein the drain or source current of the sense transistor is set to a value representing the first threshold.

11. The method of claim 8 wherein sampling a load current value comprises sampling a load current value at the low-side transistor or at the high-side transistor, dependent on the digital duty cycle value.

* * * * *